US005421801A

United States Patent [19]

Davies, III et al.

[11] Patent Number: 5,421,801

[45] Date of Patent: Jun. 6, 1995

[54] STRETCHING MACHINE

[76] Inventors: D. Robert Davies, III, 10250 Dakins Dr., Richmond, Va. 23236; David Dise, 8532 Waxford Rd., Richmond, Va. 23235

[21] Appl. No.: 73,945

[22] Filed: Jun. 8, 1993

[51] Int. Cl.[6] ..... A63B 23/035

[52] U.S. Cl. ..... 482/131; 482/133; 482/907; 601/33

[58] Field of Search ..... 482/131, 133, 134, 142, 482/148, 907, 909; 128/25 R, 25 C; 606/243; 601/23, 24, 33, 35

[56] References Cited

U.S. PATENT DOCUMENTS

| | | | |
|---|---|---|---|
| 2,641,250 | 6/1953 | Brockman | 128/25 R |
| 3,370,584 | 2/1968 | Girten | 128/25 R |
| 3,891,207 | 6/1975 | Helliwell | 482/142 |
| 4,207,879 | 6/1980 | Safadago et al. | 482/142 |
| 4,263,879 | 8/1980 | Yakata | 482/137 |
| 4,445,684 | 5/1984 | Ruff . | |
| 4,608,969 | 9/1986 | Hamlin | 606/243 |
| 4,647,040 | 3/1987 | Ehrenfried | 482/131 |
| 4,743,010 | 5/1988 | Geraci | 482/95 |
| 4,826,158 | 5/1989 | Fields, Jr. | 482/907 |
| 4,844,453 | 7/1989 | Hestilow . | |
| 4,877,239 | 10/1989 | Dela Rosa | 482/907 |
| 5,108,090 | 4/1992 | Reed . | |
| 5,122,106 | 6/1992 | Atwood et al. . | |
| 5,137,504 | 8/1992 | Mangini . | |

OTHER PUBLICATIONS

Advertisement for "Hurley Stretch Rack".

*Primary Examiner*—Richard J. Apley
*Assistant Examiner*—Jeanne M. Clark
*Attorney, Agent, or Firm*—Whitham, Curtis, Whitham & McGinn

[57] ABSTRACT

According to the invention, a stretching machine is provided that can be used both for physical therapy/-rehabilitation and for physical fitness. The stretching machine includes both an arm and back stretching component and a leg, thigh, and calf stretching component. The arm and back stretching component includes a mechanism for allowing the user to sit and fully extend his arms either directly above his head, directly in front of his torso, or at any angle therebetween. In addition, the arm and back stretching component can be pivoted to an angular orientation with respect to the user's waist, thereby allowing different muscle groups to be stretched. The leg, thigh, and calf stretching component includes a pair of leg supports which when moved apart holds the user's legs in a spread orientation for a period of time to stretch the muscles. Preferably, the arm and back stretching component and the leg, thigh, and calf stretching component can be used in cooperation with one another to stretch a variety of muscle groups.

18 Claims, 8 Drawing Sheets

STRETCHING MACHINE

BACKGROUND OF THE INVENTION

1. Field of the Invention

The present invention generally relates to a stretching machine and, more particularly, to a machine for stretching the muscles of the arms, legs, and back without undue stress.

2. Description of the Prior Art

Stretching prior to commencing any exercise regimen is of paramount importance to reduce the likelihood of exercise related injuries. This is particularly true with regard to martial arts exercise regimens which demand optimum flexibility for swift, wide-ranged, muscle group movements. It is important that stretching be carried out with smooth continuous movements, rather than with bouncy movements, in order to avoid injuries during the stretching exercise itself. Ideally, the muscles should be in a relaxed state to maximize the stretch and to avoid undue stress on the muscle, tendons and skeleton.

Stretching is also an important part of any physical therapy regimen practiced by patients undergoing physical rehabilitation following an accident, an illness or perhaps just seeking relief from such common aliments as back pain. This type of therapy is commonly supervised by a highly trained physical therapist in a hospital setting or perhaps in the patient's home. For severely impaired patients, the therapist may maneuver the patient's limbs through a full range of motion being careful not to force or over stretch the muscles. The therapist must exercise even greater care and supervision if the patient is using a machine to stretch since a wrong machine setting or a patient who is unaware of his/her thresholds may easily over stretch and injure himself.

Traditionally, pre-exercise, post-exercise, as well as therapeutic stretching exercises, are performed on the floor using a simple floor mat or by hanging from a bar. In a typical floor stretching exercise, a person sits with his legs in a straddle position extended out in front of his torso. The person bends his torso into the mat thereby stretching his leg and back muscles. The person's arms may extend straight out over his head, in a reaching fashion, to maximize the stretch. This position is held for a period of time. The stretching may be assisted with the help of a partner or therapist. In a hanging stretch exercise, the person hangs from a bar, such as, for example, in a chin-up preparation position, and allows the weight of his own body to provide a downward stretch. This method is particularly undesirable in a therapeutic environment since, typically, the full body weight provides many times more force than is necessary or desired to accomplish the stretch. This puts undesirable strain on the muscles, particularly of the lower back. Additionally, a patient in therapy often lacks the strength in their hands that is required to support their own body weight.

In the design and manufacture of exercise machines the trend has been to move away from manual or free-weight apparatuses and to provide more machines which are designed to ensure proper movement of a specific muscle group. Although this trend has been more prevalent for muscle building exercise machines, it is becoming more prevalent for stretching machines as well.

U.S. Pat. No. 5,108,090 to Reed shows an exercising machine for stretching a user's leg and back muscles which closely simulates conventional floor exercises. A user sits with his legs extended out and locked in front of his torso. A hand-grip is provided at the end of a motorized telescoping arm for the user to grasp. Forward and reverse buttons on the hand-grip are used to control the direction of the telescoping arm as it pulls the user to the floor or pushes him back to a sitting position. This machine is mechanically complex and extremely limited in the types exercises and range of motions that can be performed. For example, this type of machine could not be used in a therapeutic environment where the patient has a back injury and is physically unable to bend at the torso. Additionally, since it is a user operated motorized machine that is actually stretching the muscles, it would be easy for an inexperienced or overzealous user to go too far and cause muscle hyperextension or some other unhealthy result.

U.S. Pat. No. 4,844,453 to Hestilow shows an example of a stretching machine where a user sits with his legs secured in a pair of leg decks which are longitudinally slidable to accommodate different size users. A hydraulic jack is used to move the leg decks in an arc movement to stretch the user's legs in a spread-eagled fashion. A handle bar is positioned in front of the user in the same plane as the user's legs to aid in front stretches.

U.S. Pat. No. 4,445,684 to Ruff shows a leg stretch machine somewhat similar to the one that is described in Hestilow. A crank and rachet mechanism is provided which, when turned, moves a pair of spreader arms to split a user's legs apart. A hand-grip is bolted to a central bar in front of the user near the ground. This allows the user to pull his upper body closer to the floor with his legs spread thereby simulating various martial arts positions.

U.S. Pat. No. 5,137,504 to Mangini shows a stretching machine where a seat is provided with pivotally mounted leg platforms extending therefrom. A user sits in the seat in an upright position with his legs strapped into the leg platforms. The machine employs a steering-wheel type crank which, when turned, moves the leg platforms and stretches the user's legs apart. A rod is positioned directly in front of the user. The rod has a left and right hand grip and a cable extending from the center of the rod to the seat backrest. When the user grasps and turns the rod, a ratchet mechanism winds the cable around the rod pulling the backrest forward and causing the user to assume a bent over posture. In this manner, the leg and back muscles are stretched simultaneously.

The aforementioned stretch exercise machines offer significant improvement over conventional floor exercises in that they ensure proper muscle movement and, in most cases, allow for holding the muscles in a stretched position for a period of time. Unfortunately, the stretch machines only allow the user to assume a straight-out, bent over posture and do not permit side-to-side movements nor vertical stretch movements which simulate hanging.

SUMMARY OF THE INVENTION

It is an object of this invention to provide an improved stretching machine that allows a wide variety of different stretches to be performed safely.

It is another object of this invention to provide a stretching machine which can be used for arm, leg, calf, back, and other muscle stretching wherein the different muscles can be stretched individually or together in a coordinated fashion.

It is another object this invention to provide a stretching machine which simulates hanging from a bar, but with the user's back and legs completely supported.

It is yet another object of this invention to provide a stretching machine which can safely move the user's legs apart in either symmetrical or asymmetrical fashion.

It is another object of this invention to provide a stretching machine which provides positive feed-back relating to the progress of the user.

According to the invention, a stretching machine is provided that can be used both for physical therapy/-rehabilitation and for physical fitness. Ideally, the stretching machine includes both an arm and back stretching component and a leg, thigh, and calf stretching component. The arm and back stretching component includes a mechanism for allowing the user to sit and fully extend his arms either directly above his head, directly in front of his torso, or at any angle therebetween. In addition, the arm and back stretching component can be pivoted to an angular orientation with respect to the user's waist, thereby allowing different muscle groups to be stretched. In the preferred embodiments, the arm and back stretching component includes a pole which projects from under the user's seat on which either a series of ladder-like pegs or hand grips are positioned or on which a handlebar rides using a ratchet mechanism. Because the user is sitting, the stretching can be performed for a longer period of time and with better results than can be achieved if the user were hanging from a chin-up bar. The leg, thigh, and calf stretching component includes a pair of leg supports in which the user positions his legs while in a seated position. The leg supports are moved apart in either symmetrical or asymmetrical fashion and the legs are held in the spread orientation for a period of time to stretch the muscles. Movement of the leg supports can be achieved using a hand operated crank or motor driven gearing or pulley arrangement. The attitude of the seat could be adjusted to provide an increased gravitational effect to the leg spreading exercise. Preferably, the arm and back stretching component and the leg, thigh, and calf stretching component can be used in cooperation with one another to stretch a variety of muscle groups. For example, the user could have the leg supports moved apart to perform leg stretching and perform arm and back stretching towards either one of the user's legs. In an alternative embodiment for the back and arm stretching component, a series of peg projections can be provided on the leg supports such that the user can stretch his legs apart and then reach for and hold onto one of the pegs associated with one of the leg supports. Foot stops can be positioned on each leg support. The foot stops can be pivotal to allow the user's ankles and toes to be oriented in a flexing or stretching exercise to benefit the hamstring or calf muscles. In addition, the foot stops can be motor driven to benefit paraplegic users who are unable to move their feet on their own.

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF A PREFERRED EMBODIMENT OF THE INVENTION

Figure 1:
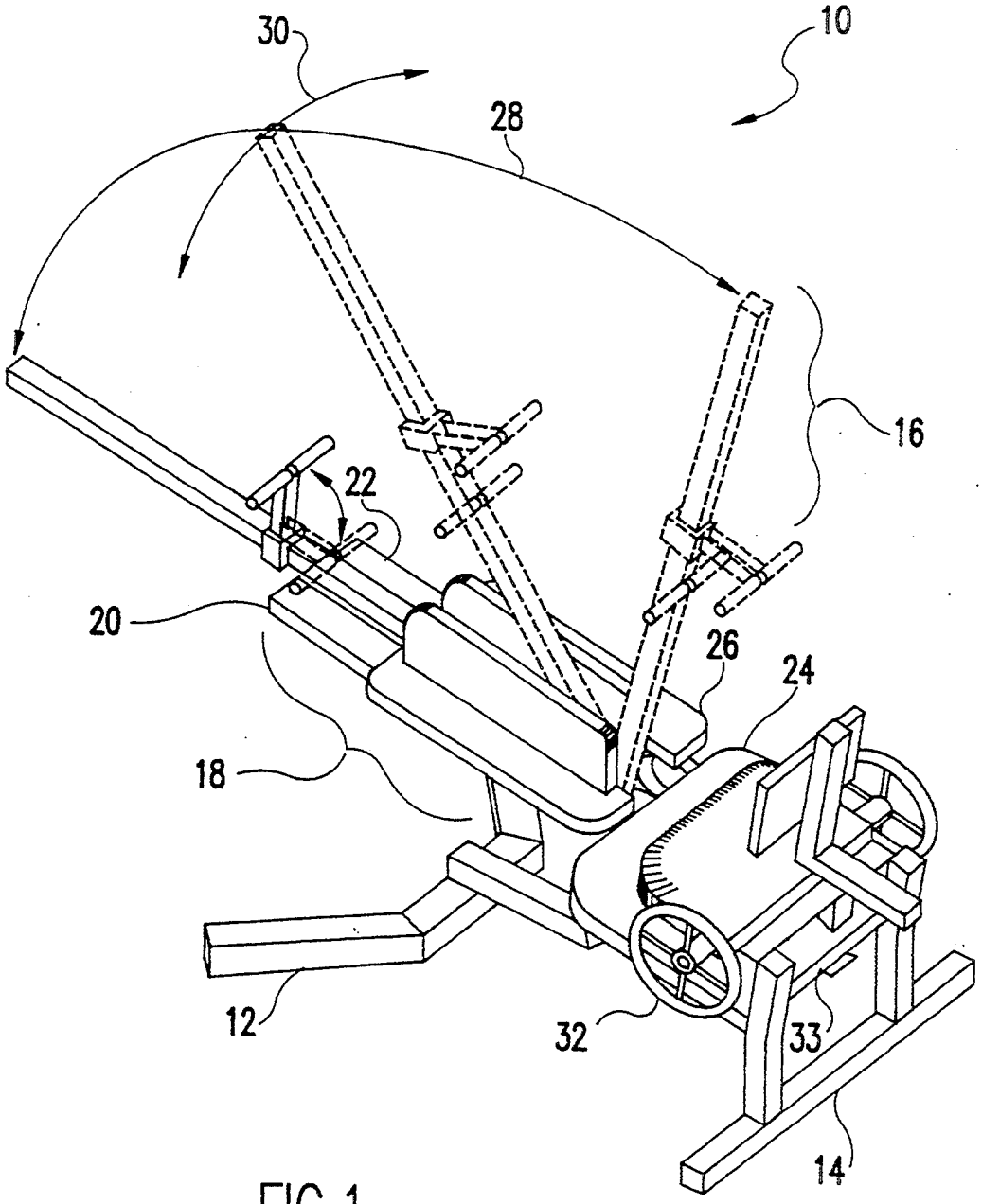
FIG. 1 is an isometric view of the stretching machine according to the invention.

Referring now to the drawings, and more particularly to FIG. 1, there is shown an isometric view of the stretching machine generally referred to by the reference numeral 10. The support frame of the stretching machine includes front 12 and rear 14 support members which are preferably made from tubular steel or similar sturdy material. In the preferred embodiment, the stretching machine includes both an arm and back stretching component 16 and a leg, thigh, and calf stretching component 18. The leg, thigh, and calf stretching component 18 includes a pair of leg supports, 20 and 22, projecting outward from a seat 24. The arm and back stretching component 16 also projects outward from the seat 24 and is pivotally mounted between the leg supports 20 and 22, respectively. The arm and back stretching component 16 includes a hinge mechanism 26 for allowing the user to sit and fully extend his arms either directly above his head, directly in front of his torso, or at any angle therebetween, as depicted by arrow 28. In addition, the arm and back stretching component can be pivoted to an angular orientation with respect to the user's waist as shown by arrow 30. The leg supports, 20 and 22, open and close in a jaw-like fashion to effectively open and stretch a user's legs and thighs. The leg supports, 20 and 22, can be moved either under the power of a user's legs, or by a mechanical mechanism such as, for example, a manual or motorized crank, gear and pulley arrangement 32. Resistance may be added in the former case where the user is using his legs to open the leg supports 20 and 22. For certain exercises or therapy regimens, it may be preferable to use a cycling motor 33 which alternates the leg supports between open and closed positions to move the user's legs between a stretched and a relaxed state.

Figure 2:
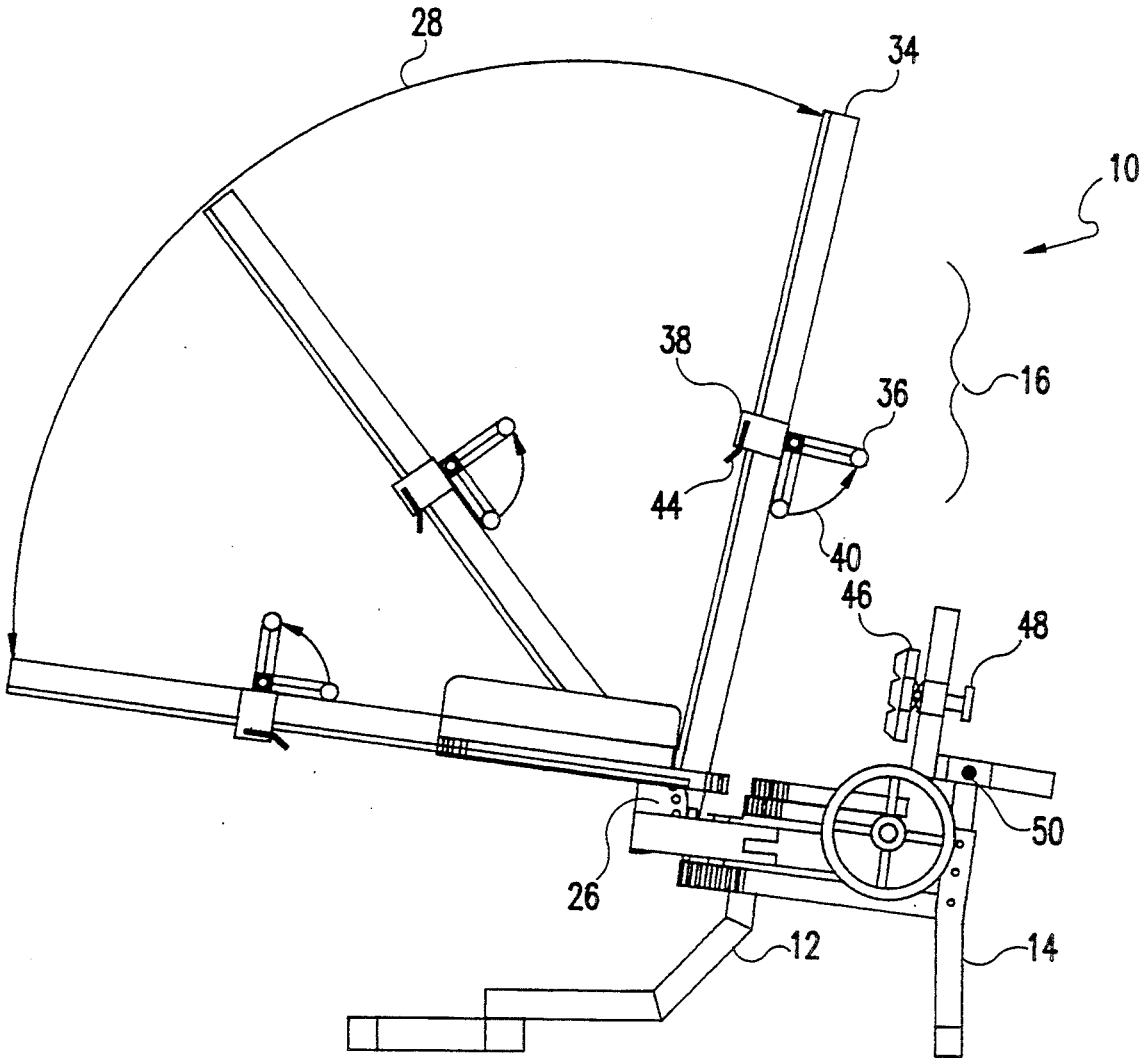
FIG. 2 is a side view of the stretching machine.

Referring now to FIG. 2, there is shown a side view of the stretching machine 10. The arm and back stretching component 16 includes a pole 34 which projects from under the user's seat 24. The pole 34 includes hand grips along its length. The hand grips may take numerous forms such as, for example, a series of ladder-like pegs (82 of FIG. 5), rubber or velcro strips, or a handlebar 36 which rides on the pole 34 using a ratchet mechanism 38. The handlebar 36 is pivotable for particular exercises and can achieve orientations between perpendicular to the pole or parallel with the pole as shown by arrow 40. In operation the user sits in the seat 24 and selects a particular pole orientation for the arm and back stretching component 16. The user initially grasps the handlebar 36 at a comfortable level and begins to stretch, pushing the handlebar 36 outward away from his body. Resistance may be added if desired to oppose the user's movements. Since, the rachet mechanism 38 permits only movement in one direction, the handlebar 36 cannot slip backwards and the machine 10 is able to hold the user in a stretched position for any desired period of time. The rachet mechanism 38 is designed to click at specific intervals, such as, for example, every centimeter. Indicia 42 is provided along the length of the pole 34 to provide positive feedback regarding the distance of the stretch and thereby allow the user to monitor his progress. Since the user is stretching his arms and back on his own initiative and not under the influence of some outside force, there is no danger of muscle hyperextension or other stretching related injury. A release lever 44 is provided to release the rachet mechanism 38 so that the handlebars 36 can be lowered for another exercise repetition. It may be necessary to assist paraplegic users when performing arm and back stretching exercises. This can be easily be accomplished by either a therapist helping user to lift the handlebars 36 or by motorizing the arm and back stretching component. In the latter case a motorized mechanism would slowly raise the handlebars 36 in a continuous motion or in incremental steps to stretch a disabled user's arms and back. For safety, an adjustable torque converter could be used which stops when a preset resistance is encountered.

Still referring to FIG. 2, an adjustable back-rest 46 is provided which is particularly effective for providing upper and lower lumber support for a user when the back and arm stretching component 16 is oriented in a vertical position. Lock knobs 48 and 50 can be used to permit the back rest to move up and down and back and forth, respectively. The attitude of the seat 24 can also be adjusted as required for certain exercises. This may be accomplished either by changing the attitude of the seat 24 with respect to the machine 10, or by adjusting the height of either the front 12 or rear 14 support to change the angle of the entire machine 10 and thereby increase the gravity effect on the exercise.

Figure 3:
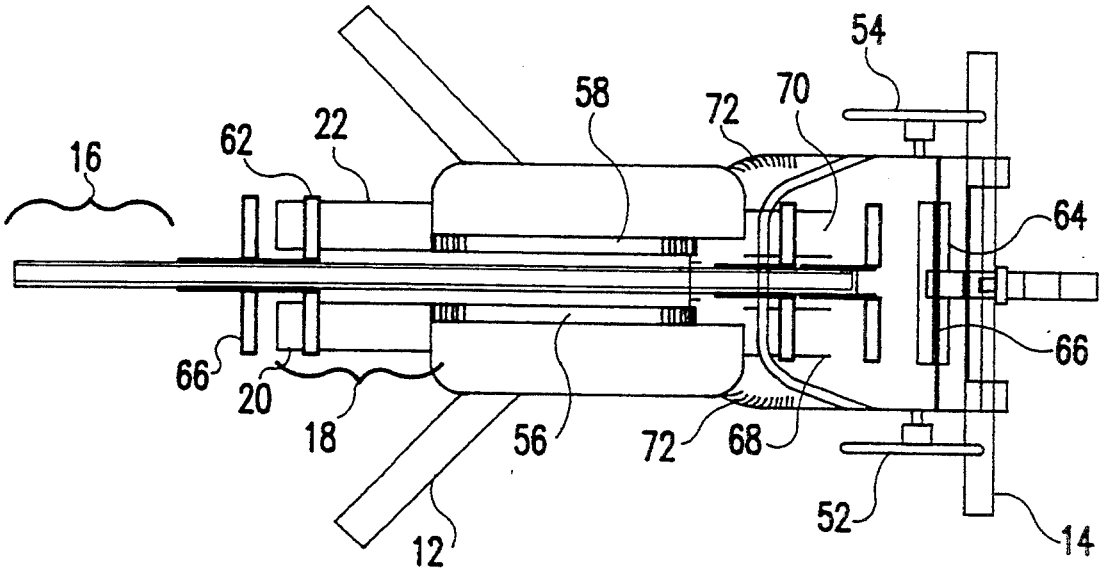
FIG. 3 is a top view of the stretching machine in a closed position.

Referring now to FIG. 3, the leg, thigh, and calf stretching component 18 includes a pair of leg supports, 20 and 22, which are shown in a closed position. In operation, a user positions his legs in the leg supports, 20 and 22, while in a seated position. As discussed above, the leg supports can be moved apart by either the force of the user's legs or by the mechanical cranks, 52 and 54. Leg stops, 56 and 58, and foot stops, 60 and 62, keep the user's legs securely positioned on the leg supports, 20 and 22, respectively, throughout a stretching exercise. The foot stops, 60 and 62, pivot to allow toe pointing or flexing during the exercise to stretch the calf muscle or hamstring. The leg stops, 56 and 58, are positioned to keep the user's legs from moving forward during an exercise. Crank 52 and crank 54 can be connected together such that turning either crank causes the leg supports, 20 and 22, to spread in a symmetrical fashion. Alternatively, crank 52 and crank 54 can be geared to work independently of one another such that turning either crank will cause only a corresponding leg support to open in an asymmetrical fashion. In either case, the legs are held in the spread orientation for a period of time to stretch the muscles. There are numerous ways that such a mechanical motion can be realized. In the preferred embodiment, the crank 52 is connected to a shaft 64. When the crank 52 is rotated, teeth on the shaft 64 mesh with a drive gear 66 which in turn rotates a gear 68 connected to a corresponding leg support 20 and thereby causes it to open or close independent of the other leg support 22. Likewise, turning crank 54 causes leg support 22 to open. If the leg supports, 20 and 22, are to open in a symmetrical fashion, then a gear 70, connected to leg support 22, meshes with gear 68 and turning either crank 52 or crank 54 causes the leg supports 20 and 22 to move in equal and opposite directions. The gear ratio is such that one turn of the crank, 52 or 54, moves the leg supports, 20 or 22, exactly one degree. The exact orientation of the leg supports, 20 and 22, is readily ascertainable by indicia 72 to provide positive feedback to the user about his progress. This is particularly useful in therapeutic environments wherein close monitoring of progress is desired.

Figure 4:
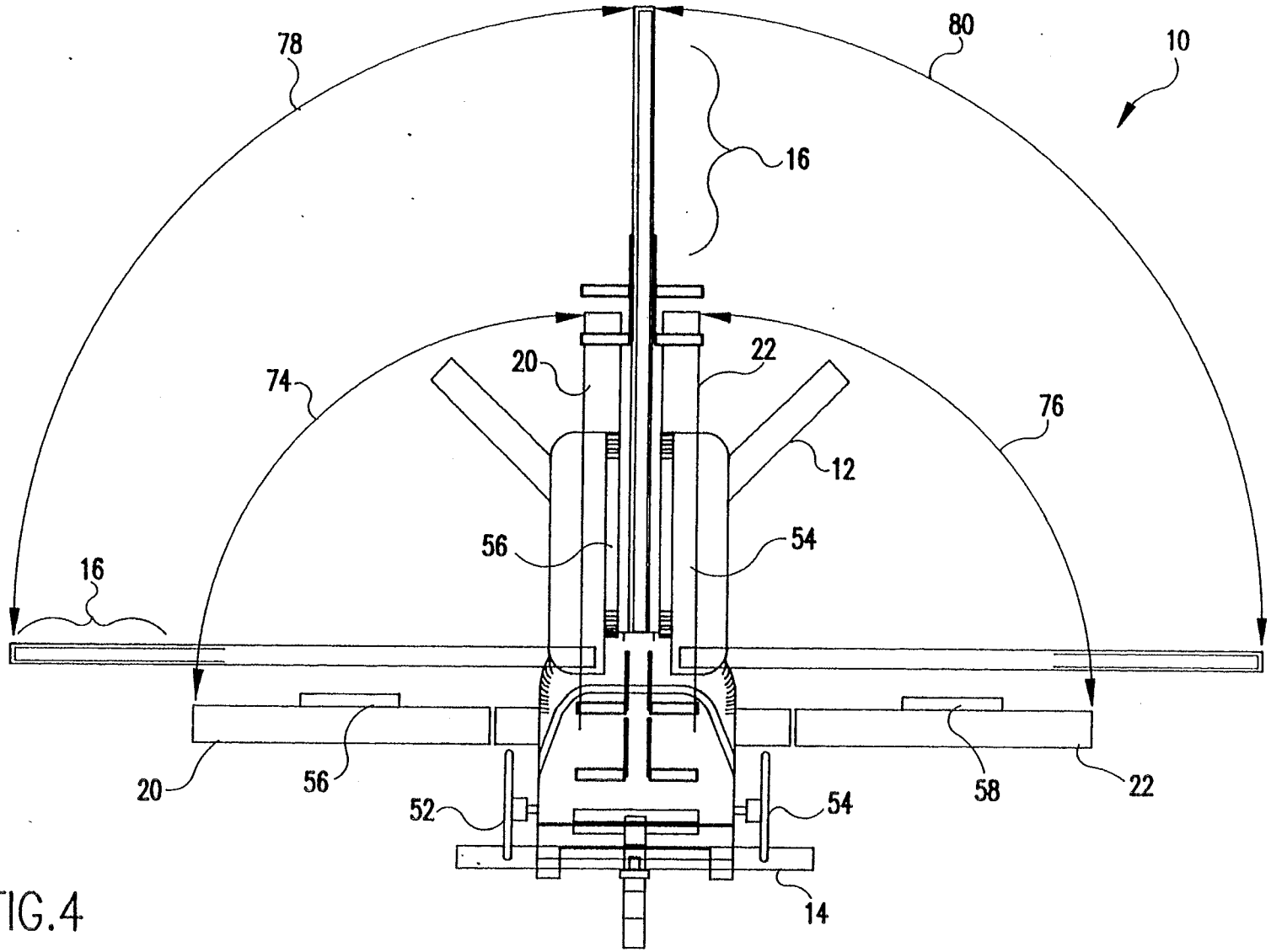
FIG. 4 is a top view of the stretching machine in an open position.

Referring now to FIG. 4, the machine 10 is shown in its open configuration illustrating the complete range of horizontal motion. Preferably, the leg supports, 20 and 22, will be prevented from opening wider than 210°. The range of motion for the left 20 and right 22 leg supports is shown by arrows 74 and 76, respectively. For optimal stretching the leg supports, 20 and 22, should be at least openable to 180°. Leg-stops, 56 and 58, are provided on each of the leg supports, 20 and 22, and are designed to hold a user's legs in a stretched position by preventing them from moving inward during an exercise. If leg straps are not used, the user will be free to dismount at any time. The horizontal orientations of the arm and back component is shown by arrows 78 and 80. As discussed above, the arm and back component is also capable of vertical orientations (out of the page).

Figure 5:
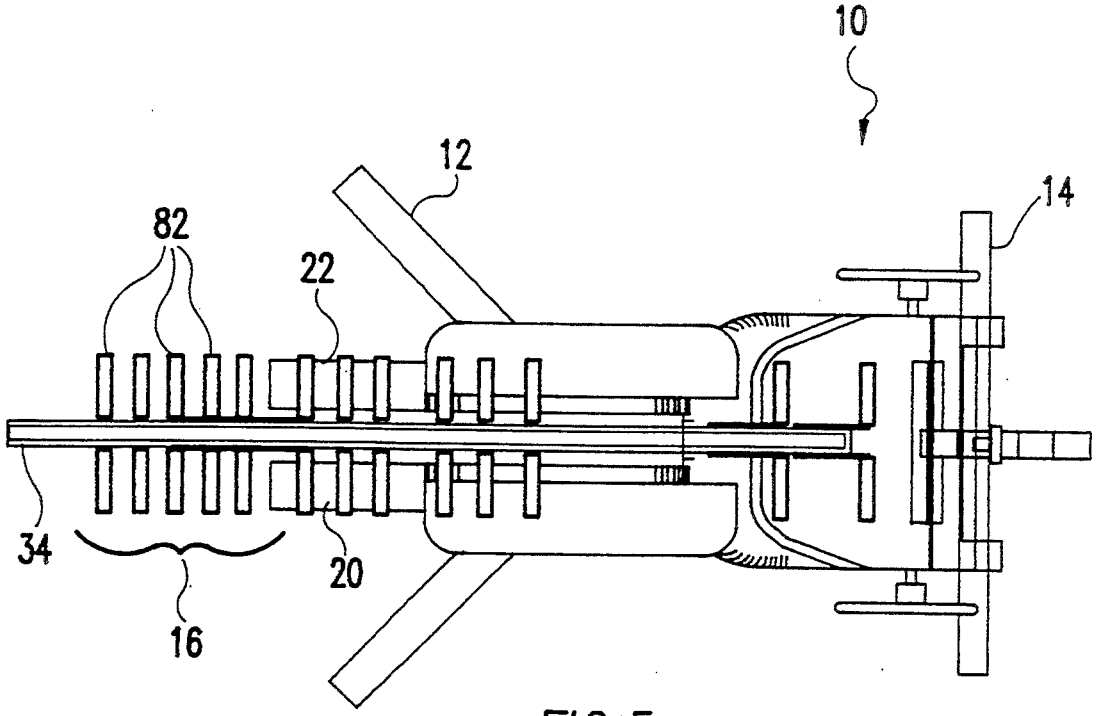
FIG. 5 is a view of the arm and back stretching component having ladder rung projections extending along their length.
Figure 6:
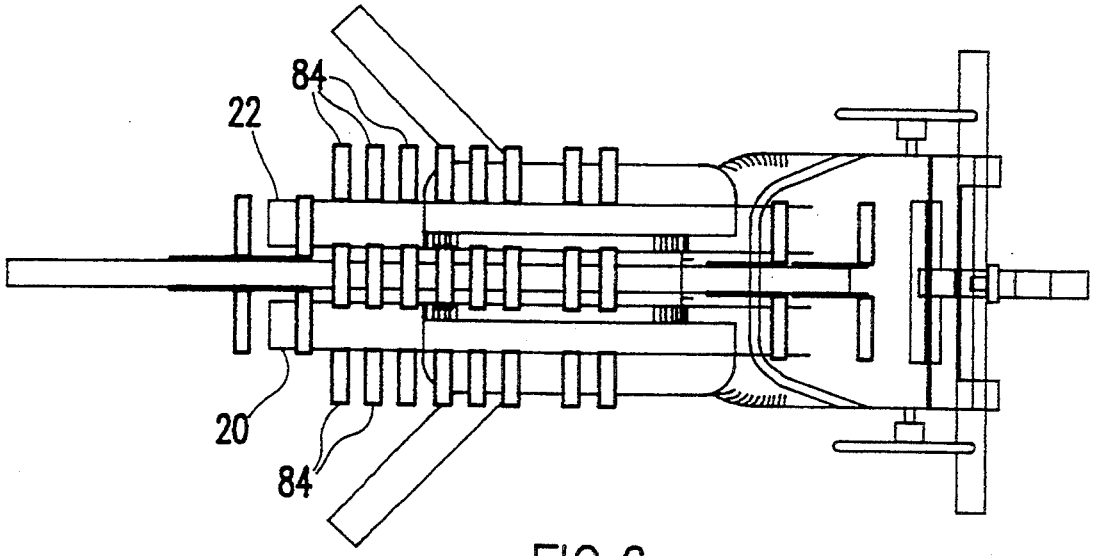
FIG. 6 is a view of the leg supports having ladder rung projections along its length.
Figure 7:
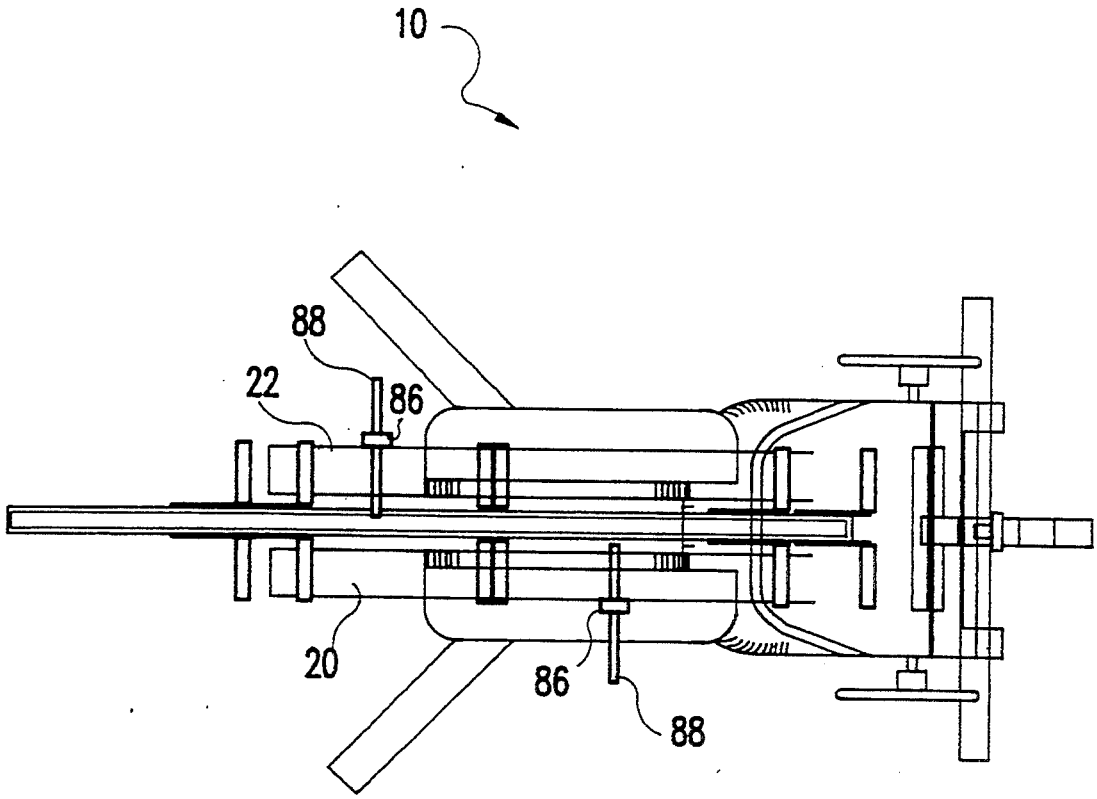
FIG. 7 is a view of the leg supports having associated handlebar and ratchet mechanisms.

FIG. 5 shows an alternate embodiment wherein the pole 34 of the arm and back stretching component 16 has a series of ladder-like pegs 82 positioned thereon rather than the rachet and handlebar mechanism previously described. In this embodiment, the user "climbs" the ladder-like pegs 82 with his hands thus stretching his arms and back. Similarly, as shown in FIG. 6, a series of peg projections 84 can be provided on the leg supports, 20 and 22, such that the user can stretch as he reaches for and climbs successive pegs 84 associated with one of the leg supports, 20 or 22. Likewise, as shown in FIG. 7, a ratchet mechanism 86 and handlebar 88 arrangement may also be associated with the leg supports 20 and 22. In this case, the user pushes the handlebar 88 in a direction toward his toes and the ratchet mechanism 86 prevents the user from slipping backwards. This aids a user in reaching toward the toes which is a movement frequently performed in stretching regimens.

Figure 8:
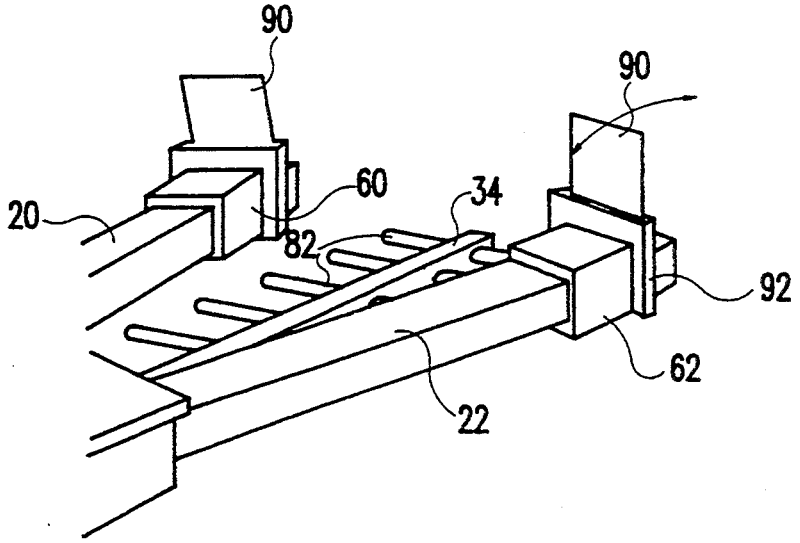
FIG. 8 is a view of the foot stop.

FIG. 8 shows a view of the foot stops, 60 and 62, which are adjustably positioned on each leg support, 20 and 22, respectively, to adjust to any leg length. Each foot-stop, 60 or 62, has a pivoting back member 90 which allows the orientation of a user's foot to be controlled in the performance of the stretching exercises. The back member 90 may include a motor 92 which allows the back member 90 to cycle from toe forward to heel forward for paraplegic therapy. The foot stops, 60 and 62, may also be spring loaded to maintain contact with the user's foot regardless of the opening of the leg support, 20 or 22.

While the invention has been described in terms of a its preferred embodiment, those skilled in the art will recognize that the invention can be practiced with modification within the spirit and scope of the appended claims.

Having thus described our invention, what we claim as new and desire to secure by Letters Patent is as follows:

1. A stretching apparatus, comprising:

a seat, a pair of leg supports extending in a generally forward direction from said seat, said leg supports for holding the legs of a user perpendicular to the user's torso when in a sitting position in said seat;

a pivotal pole extending from said seat between said pair of leg supports;

pivot means for moving said pivotal pole towards and away from said seat;

means for selectively positioning said pivotal pole in a desired orientation; and hand-grip means for gripping said pole, said hand-grip means being grippable in a first position along said pole close to said seat and being further grippable at subsequent positions extending along the length of said pole further from said seat as the user stretches, wherein said hand-grip means is slidably connected to said pole and said hand-grip means includes a mechanism for holding said hand grip means in a desired position relative to said pole, said hand grip means being adapted to slid in a forward direction along said pole as the user stretches.

2. A stretching apparatus as recited in claim 1 wherein said pivot means is close to said seat.

3. A stretching apparatus a recited in claim 2 wherein said pole is pivotally moveable to the left and right side of said seat.

4. A stretching apparatus as recited in claim 1 wherein said leg supports are pivotally mounted with respect to said seat and adapted to be moved to the left and right side of said seat.

5. A stretching apparatus as recited in claim 4 further comprising a crank means connected to said leg supports for causing said leg supports to open and close in an arc motion.

6. A stretching apparatus as recited in claim 4 wherein each of said leg supports further comprise a leg stop positioned to abut an inside surface of a user's leg.

7. A stretching apparatus as recited in claim 1 further comprising a foot stop slidably positioned along each of said leg supports, said foot stop adapted to engage the bottom of the user's foot and being pivotal to permit the user's foot to assume a toe forward or heal forward position.

8. A stretching apparatus as recited in claim 7 wherein said foot stop is motor driven to pivot the user's foot between a toe forward and heal forward position.

9. A stretching apparatus as recited in claim 1 further comprising an adjustable backrest associated with said seat.

10. A stretching apparatus as recited in claim 1, wherein said leg supports including a handlebar slidably connected to said leg supports and a mechanism for holding said handlebar in a desired position relative to said leg supports.

11. A stretching apparatus as recited in claim 1, wherein said leg supports include a plurality of ladder rungs distributed in discrete locations along the length of said leg supports.

12. A stretching apparatus, as recited in claim 1, wherein said mechanism is a ratchet mechansim.

13. A stretching apparatus, comprising:

a seat;

a pair of leg supports extending in a generally forward direction from said seat, said leg supports for holding the legs of a user perpendicular to the user's torso when in a sitting position in said seat;

a piuvotal pole extending from said seat between said pair of leg supports;

pivot means for moving said pivotal pole towards and away from said seat;

means for selectively positioning said pivotal pole in a desired orientation; and hand-grip means for gripping said pole, said hand-grip means being grippable in a first position along said pole close to said seat and being further grippable at subsequent positions extending along the length of said pole further from said seat as the user stretches, wherein said hand-grip means comprises a plurality of ladder rungs distributed in discrete locations along the length of said pole wherein the user can grip progressive rungs of said plurality of ladder rungs as the user stretches.

14. A stretching machine, comprising:

a seat, a pair of leg supports pivotally connected to said seat positioned to hold a user's legs perpendicular to the user's torso when the user is in a sitting position, said leg supports having means to move in a substantially horizontal arc motion, thereby stretching the user's leg and thigh muscles; and hand-grip means, positioned along the sides of said leg supports, for gripping said leg supports, said hand-grip means being grippable in a first position close to said seat and being further grippable at subsequent positions extending along the length of said leg supports further from said seat as the user stretches, wherein said hand grip means is slidably connected to said leg supports and includes a mechanism for holding said hand grip means in a desired position to leg supports, said hand-grip means being adapted to be slid in a forward direction along said leg supports as the user stretches.

15. A stretching machine as recited in claim 14 wherein foot stops are slidably connected to said leg supports adapted to engage the bottom of the user's foot and being pivotal to permit the user's foot to assume a pointed or flexed position.

16. A stretching apparatus as recited in claim 15 wherein said foot stops are motor driven to cycle the user's foot between a toe forward and heal forward position.

17. A stretching apparatus, as recited in claim 14, wherein said mechanism is a ratchet mechanism.

18. A stretching machine, comprising:

a seat, a pair of leg supports pivotally connected to said seat positioned to hold a user's legs perpendicular to the user's torso when the user is in a sitting position, said leg supports having means to move in a substantially horizontal arc motion, thereby stretching the user's leg and thigh muscles; and hand-grip means, positioned along the sides of said leg supports, for gripping said leg supports, said hand-grip means being grippable in a first position close to said seat and being further grippable at subsequent positions extending along the length of said leg supports further from said seat as the user stretches, wherein said hand grip means is a plurality of ladder rungs distributed in discrete locations along the length of said leg supports whereby the user can grip progressive ones of said ladder rungs as the user stretches.

* * * * *